US006493967B2

(12) United States Patent
Holmes et al.

(10) Patent No.: US 6,493,967 B2
(45) Date of Patent: Dec. 17, 2002

(54) APPARATUS FOR ATTACHING AN ACCESSORY TO AN EXCAVATOR

(76) Inventors: Frederick J. Holmes, 660 Pickering Dr., Shelton, WA (US) 98584; David C. Holmes, 841 E. Pickering Rd., Shelton, WA (US) 98584

( * ) Notice: Subject to any disclaimer, the term of this patent is extended or adjusted under 35 U.S.C. 154(b) by 0 days.

(21) Appl. No.: 09/860,450

(22) Filed: May 21, 2001

(65) Prior Publication Data

US 2001/0045031 A1 Nov. 29, 2001

Related U.S. Application Data

(60) Provisional application No. 60/207,198, filed on May 26, 2000.

(51) Int. Cl.[7] ..... E02F 3/96
(52) U.S. Cl. ..... 37/468; 414/912
(58) Field of Search ..... 37/403, 468, 407, 37/231; 172/817, 811, 245; 414/912, 723

(56) References Cited

U.S. PATENT DOCUMENTS

| | | | | | |
|---|---|---|---|---|---|
| 3,039,210 | A | * | 6/1962 | Slaughter | 37/117.5 |
| 3,440,744 | A | | 4/1969 | Smith | |
| 3,469,330 | A | | 9/1969 | Hood et al. | |
| 3,665,622 | A | * | 5/1972 | Lamb | 248/228.1 |
| 3,864,793 | A | * | 2/1975 | Guest | 24/569 |
| 3,866,342 | A | * | 2/1975 | Cooper | 172/817 |
| 3,942,271 | A | | 3/1976 | George | |
| 4,009,529 | A | | 3/1977 | Johnson | |
| 4,189,854 | A | | 2/1980 | Haynes | |
| 4,242,035 | A | * | 12/1980 | Hornstein | 37/405 |
| 4,255,884 | A | | 3/1981 | Williams | |
| 4,328,628 | A | | 5/1982 | Thomas | |
| 4,360,980 | A | | 11/1982 | Jarvis | |
| 4,463,507 | A | | 8/1984 | Gaub | |
| 4,521,980 | A | | 6/1985 | Solaja | |
| 4,597,205 | A | * | 7/1986 | Guest | 172/273 |
| 4,619,060 | A | * | 10/1986 | Knowlton | 37/231 |
| 4,813,164 | A | * | 3/1989 | Morrell | 37/231 |
| 5,111,603 | A | * | 5/1992 | Knowlton et al. | 172/272 |
| 5,142,799 | A | * | 9/1992 | Wood | 37/403 |
| 5,165,191 | A | | 11/1992 | Davis | |
| 6,088,939 | A | * | 7/2000 | Logan | 37/404 |

FOREIGN PATENT DOCUMENTS

| | | |
|---|---|---|
| JP | 4-231523 | 8/1992 |

* cited by examiner

*Primary Examiner*—Thomas B. Will
*Assistant Examiner*—Kristine Markovich
(74) *Attorney, Agent, or Firm*—Richard C. Litman

(57) ABSTRACT

The apparatus for attaching an accessory to an excavator is a device for attaching a grader blade, brush blade, compactor, or other accessory to the bucket of an excavator. The apparatus has a body to which the accessory is attached which has a pair of hooks which slide between adjacent pairs of teeth on an edge of the excavator bucket and a pair of chains attached to the rear of the bucket and tightened by load binders to retain the apparatus on the excavator bucket. The apparatus provides for pivoting the accessory laterally, and may optionally provide for tilting the accessory in a vertical plane.

3 Claims, 10 Drawing Sheets

APPARATUS FOR ATTACHING AN ACCESSORY TO AN EXCAVATOR

CROSS-REFERENCE TO RELATED APPLICATION

This application claims the benefit of U.S. Provisional Patent Application Serial No. 60/207,198, filed May 26, 2000.

BACKGROUND OF THE INVENTION

1. Field of the Invention

The present invention relates to earthmoving machinery and equipment, and particularly to an apparatus for attaching a blade, compactor, or other accessory to the shovel of an excavator.

2. Description of Related Art

Earthmoving machinery and equipment has greatly facilitated the construction of buildings, highways, bridges, and other structures. A variety of machines are available, from the general purpose bulldozer to more specialized equipment, including front end loaders, backhoes, graders, scrapers, etc. Although specialized equipment makes many tasks easier, a drawback to the variety of equipment available is that each machine is very expensive. Apparatus for attaching an accessory to an earthmoving machine so that it may perform the function of two machines is therefore desirable. Several patents describe apparatus for attaching blades to the bucket of front end loaders and backhoes.

U.S. Pat. No. 3,440,744, issued Apr. 29, 1969 to S. G. Smith, describes a blade attachment for a front end loader which includes a frame with a mounting edge member having a recess which receives the teeth on the lower edge of the front end loader bucket, the edge member having a length equal to the side to side width of the bucket. U.S. Pat. No. 3,469,330, issued Sep. 30, 1969 to Hood, et al., discloses a blade attachment for a backhoe, the blade having U-shaped pockets on its rear surface for receiving the teeth on the backhoe bucket. U.S. Pat. No. 3,942,271, issued Mar. 9, 1976 to A. J. George, teaches a blade for attachment to a backhoe which includes a V-shaped housing for receiving the teeth of the backhoe bucket. U.S. Pat. No. 4,009,529, issued Mar. 1, 1977 to L. M. Johnson, shows a blade attached to a backhoe bucket by a series of clamp plates engaging the teeth of the backhoe bucket, the clamp plates being on both sides of the teeth and secured to the bucket by nuts and bolts.

U.S. Pat. No. 4,189,854, issued Feb. 26, 1980 to J. A. Haynes, describes a grader blade attachable to a front end loader of a backhoe by a bifurcated member having one leg extending into the bucket and secured by a plurality of jackscrews, the other leg extending below the bucket and having an L-shaped member to which the blade is pivotally attached. U.S. Pat. No. 4,328,628, issued May 11, 1982 to B. N. Thomas, discloses a snow plough attachment for a front end loader including a blade with a frame pivotally attached to the rear of the blade, the frame being attached to the bucket by angles which engage the lower edge of the bucket, brackets inside the bucket which engage the frame, and a connector arm pinned to the top edge of the bucket. A semicircular beam is attached to the rear of the blade and slidable through sleeves attached to the frame, with hydraulic cylinders mounted between the frame and the circular beam to vary the angle of the blade.

U.S. Pat. No. 4,255,884, issued Mar. 17, 1981 to E. D. Williams, teaches a snow plough attachment for a front end loader in which the blade has a pair of brackets on its rear surface, the brackets supporting pins on their upper ends which are received by hooks attached to the top edge of the loader bucket, and having slots defined in their lower ends for receiving the bottom edge of the bucket. U.S. Pat. No. 4,360,980, issued Nov. 30, 1982 to J. D. Jarvis, shows a blade attached to a backhoe by an inclined plate with bosses forming a pocket for receiving the bucket teeth, the plate being secured to the bucket by a turnbuckle.

U.S. Pat. No. 4,463,507, issued Aug. 7, 1984 to A. A. Gaub, describes a grader blade attachment for a front end loader or backhoe in which the blade attachment has a support arm which has an upright post at one end which fits between ears on the rear of the bucket and is secured to the ears by a pin. U.S. Pat. No. 4,521,980, issued Jun. 11, 1985 to N. Solaja, discloses a grader blade attached to a loader bucket, the blade being mounted on a cylinder having a slot defined therein for receiving the front edge of the bucket, the cylinder being secured to the bucket by chains.

U.S. Pat. No. 5,165,191, issued Nov. 24, 1992 to C. J. Davis, teaches a front end loader with a bucket convertible to a dozer blade, the dozer blade forming the back wall of the bucket. Japanese Patent No. 4-231523, published 08/1992, shows an earth removing device for an extra-small-size shovel car which shows a blade connected to a shovel or bucket by a spring.

There are, however, problems associated with known devices for attaching grader blades and other accessories to the bucket of an earthmoving machine. Several of these devices are attached directly to or over the teeth of the bucket, leading to failure of the teeth from fatigue and wear. Several of the devices do not provide for adjustment of the angle of the blade about a vertical axis, nor for adjustment of the tilt of the blade vertically. Several of the devices require modification of the bucket, or are time consuming, cumbersome and inefficient to install and dismount from the bucket.

An apparatus for attachment of a grader blade, compactor, or other accessory to the bucket of an excavator to expand the functionality of the excavator would be advantageous, inasmuch as the excavator is a tracked vehicle with an extensible and powerful boom which can operate in areas where a bulldozer would have difficulty competing, such as on wet or soft ground.

None of the above inventions and patents, taken either singly or in combination, is seen to describe the instant invention as claimed.

SUMMARY OF THE INVENTION

The apparatus for attaching an accessory to an excavator is a device for attaching a grader blade, brush blade, compactor, or other accessory to the bucket of an excavator. The apparatus comprises a body having a front end and a rear end. A pair of hooks rise from the front end of the apparatus body and are inserted between the bucket teeth in order to engage the lower edge of the bucket. A pair of chains are attached to the rear end of the accessory body, the other end of the chains being attached to the rear of the bucket. Load binders are used to tighten the chains and firmly attach the body of the apparatus to the bottom of the bucket.

In a preferred embodiment, the body of the apparatus is a hollow C-shaped box. A hollow pie-shaped wedge has one sided welded to the accessory, viz., the rear face of a blade. The opposite V-shaped end fits in the open front end of the C-shaped box and is secured by a pivot pin so that the accessory pivots laterally. Hydraulic cylinders are attached between the sides of the C-shaped box and the accessory to control pivoting of the accessory.

In another embodiment, the body of the apparatus has a front face from which a support arm having a ball at its free end extends. The ball engages a socket mounted on the accessory so that the accessory is pivotally mounted on the support arm. In the case of a grader blade, hydraulic cylinders are attached to the apparatus body with their pistons attached to the blade to control the angle and tilt of the blade. In another embodiment, a post depends from, and is pivotally attached to, the bottom surface of the apparatus body. The accessory is pivotally mounted to the post. The angle and tilt of the blade or other accessory are adjusted manually.

Accordingly, it is a principal object of the invention to provide an apparatus for attaching a grader blade, compactor, or other accessory to the bucket of an excavator.

It is a further object of the invention to an apparatus for mounting a grader blade or other accessory to an excavator which is quick and convenient to use.

Still another object of the invention is to provide an apparatus for attaching a grader blade to the bucket of an excavator which includes means for adjusting the angle and, optionally, the tilt of the blade.

It is an object of the invention to provide improved elements and arrangements thereof in an apparatus for the purposes described which is inexpensive, dependable and fully effective in accomplishing its intended purposes.

These and other objects of the present invention will become readily apparent upon further review of the following specification and drawings.

BRIEF DESCRIPTION OF THE DRAWINGS

Similar reference characters denote corresponding features consistently throughout the attached drawings.

DETAILED DESCRIPTION OF THE PREFERRED EMBODIMENTS

Figure 1:
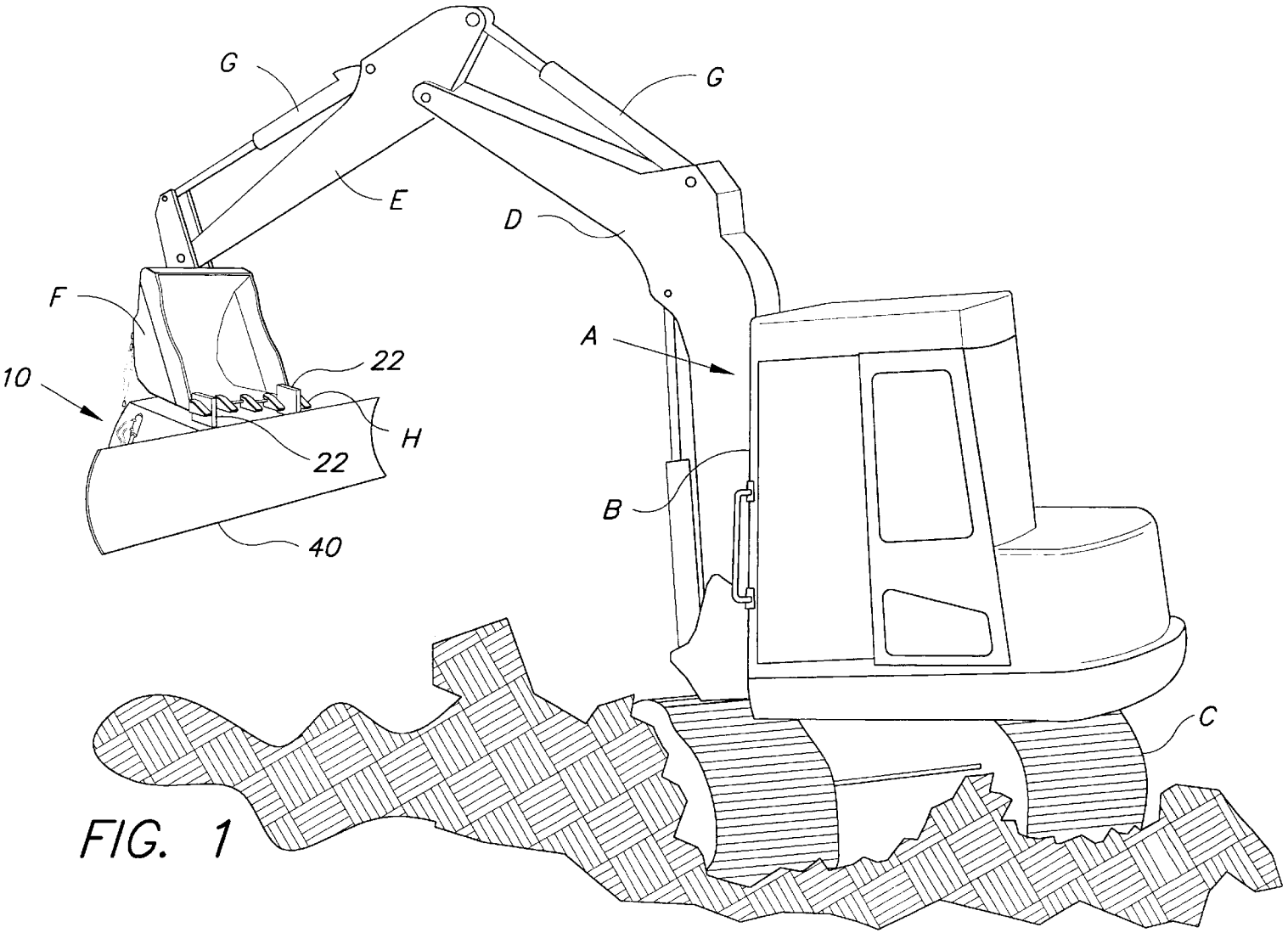
FIG. 1 is an environmental, perspective view of an apparatus for attaching an accessory to an excavator according to the present invention.

The present invention is an apparatus for attaching an accessory to an excavator. Although the invention is illustrated for attaching a grader blade to an excavator, it will be understood that the apparatus may be used to attach a brush blade, a compactor, or other accessory to an excavator. It will also be understood that although the apparatus is particularly well suited for attaching an accessory to an excavator, the principles of the present invention may be applied to an apparatus for attaching an accessory to a front end loader, backhoe, or other earthmoving machine having a bucket. A first embodiment of the apparatus, designated generally as 10 in the drawings, is shown in FIGS. 1–4.

As shown in FIG. 1, a typical excavator A has cab B rotatably mounted on a crawler C having tracked wheels. A boom D is mounted adjacent the cab B. A stick or shovel arm E is articulated with the boom D, the shovel arm E having a shovel bucket F pivotally mounted to the end distal from the boom D. A plurality of hydraulic cylinders G controlled by an operator in the cab B are used to maneuver the boom D and shovel F. The bucket F is shown as a one-piece bucket for ease in illustration; however, it will be understood that the apparatus 10 is also adapted for use with a split bucket having two jaws which open and close under hydraulic control. The tracked wheels C, rotatable cab B and boom D, articulated and extensible shovel arm E, and hydraulically controlled bucket F make the excavator A a highly versatile, maneuverable power shovel superior to other earthmoving equipment for many applications. In FIG. 1 the apparatus 10 is used to attach a grader blade 40 to the bucket F to take advantage of the maneuverability of the excavator A and the power and extensible reach of the boom D to grade the earth, thereby also avoiding the cost and expense of a separate earth moving machine for the grading operation.

Figure 2:
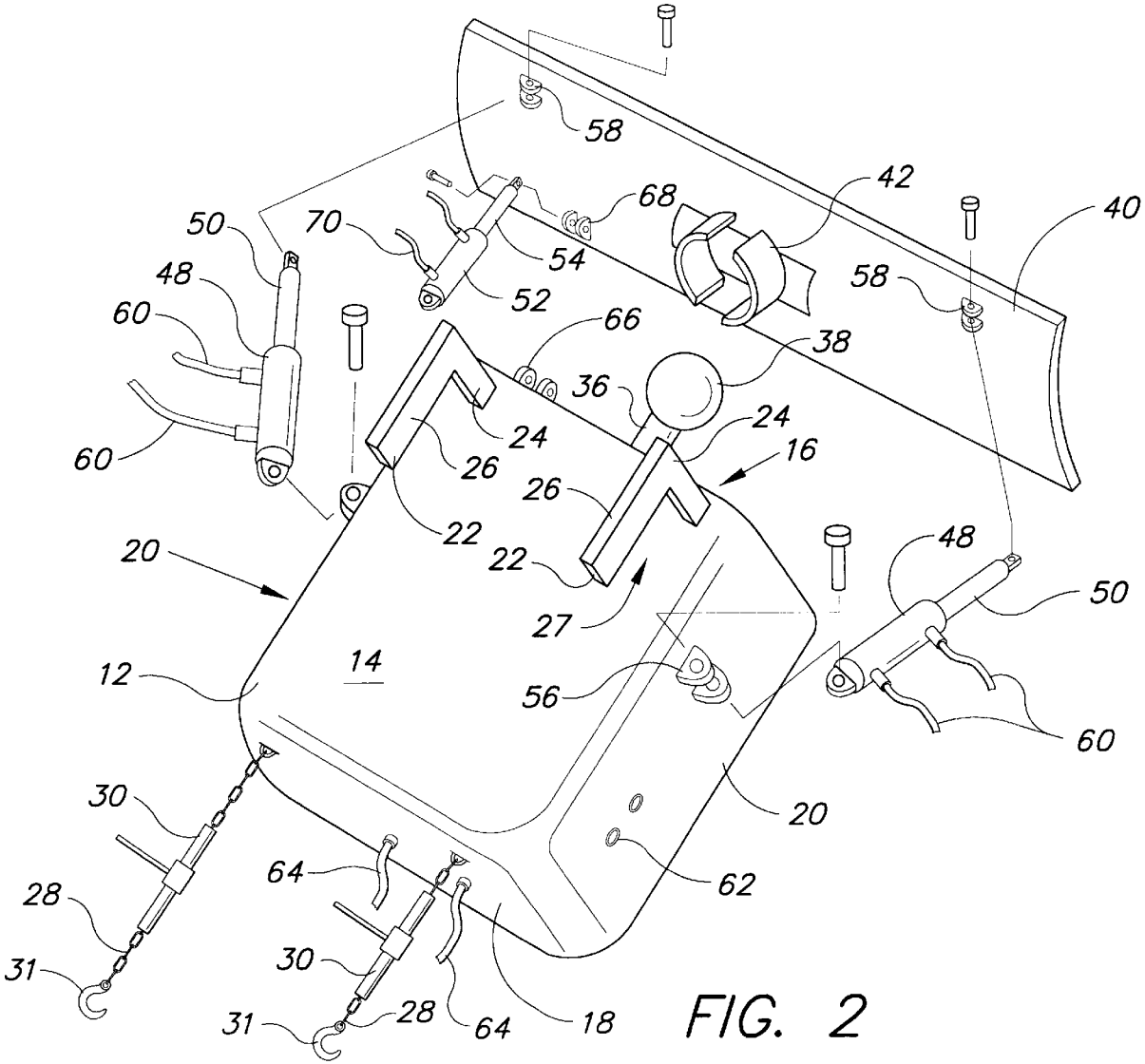
FIG. 2 is an exploded view of an apparatus for attaching an accessory to an excavator according to the present invention.
Figure 3:
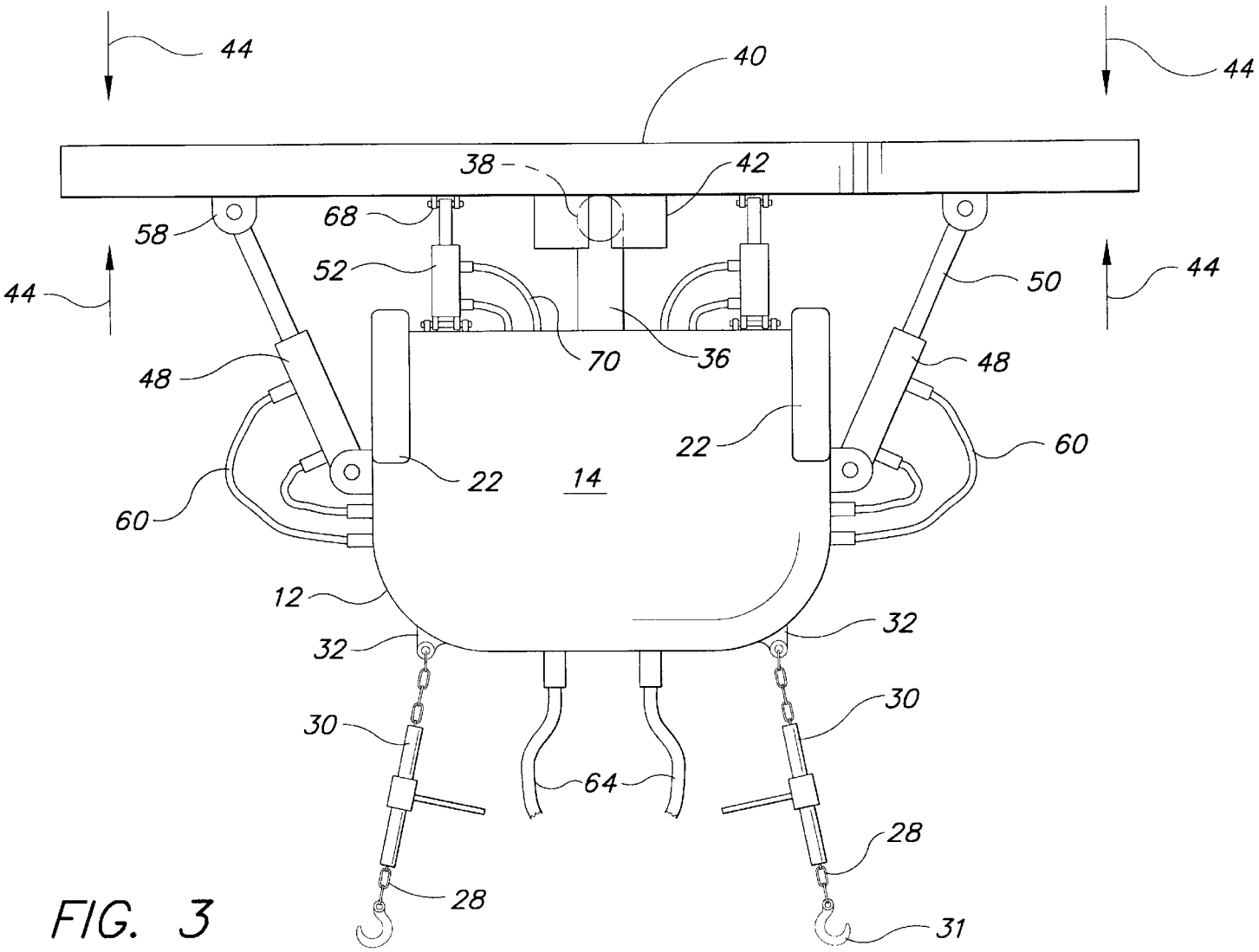
FIG. 3 is a plan view of an apparatus for attaching an accessory to an excavator according to the present invention.
Figure 4:
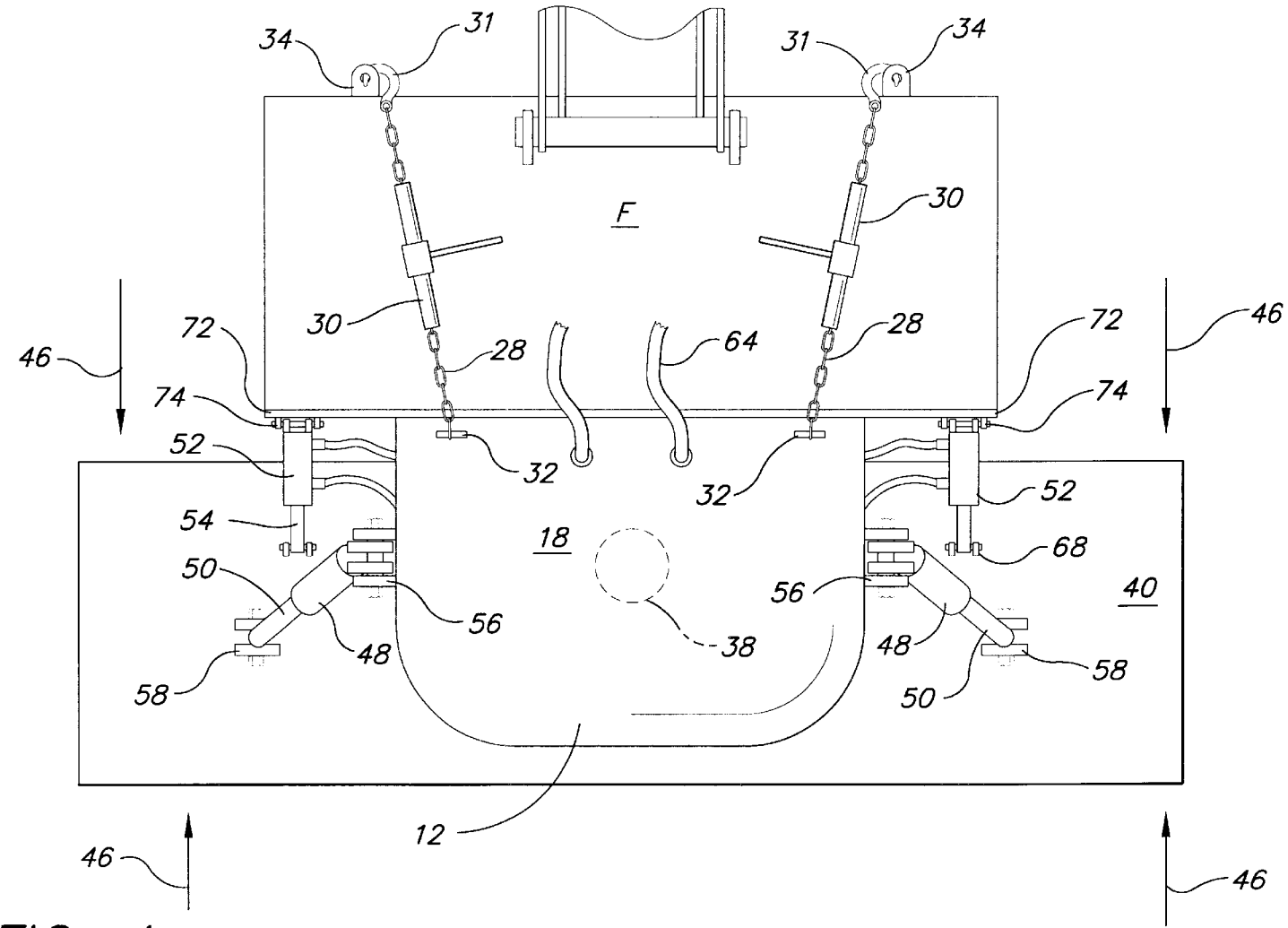
FIG. 4 is a rear view of an apparatus for attaching an accessory to an excavator according to the present invention.

As shown more clearly in FIGS. 2–4, the apparatus 10 comprises a body 12 having a top surface 14, a front face 16, a rear face 18, and opposing side faces 20. A pair of hooks 22 arise from the front end of the body 12, each hook 22 having a vertical leg 24 and a horizontal leg 26. The vertical leg 24 may be canted forward to extend beyond the leading edge of the bucket F. The horizontal leg 26 extends backwards and is generally parallel to and above the top surface 14 of the body 12. A conventional excavator bucket F has five teeth H mounted on its leading edge. The hooks 22 are spaced apart so that each horizontal leg 26 is slidable between a pair of adjacent teeth H, the hooks 22 and the top surface 14 of the body 12 defining slots 27 for receiving the leading edge of the bucket F. The hooks 22 may be spaced to fit between teeth two-three and three-four in the middle of the edge of the bucket F, or between teeth one-two and four-five on opposite sides of the leading edge of the bucket F, as shown in FIG. 1. The hooks 22 may be made from 1½" thick steel plate.

The apparatus 10 includes a pair of chains 28, each chain 28 including a ratcheting load binder 30 for tightening the chain 28, as known in the art. The body 12 has a pair of eyelets 32 extending from the rear surface 18 or other means for attaching one end of each chain 28 to the body 12. The other end of the chains 28 is attached to the excavator A in any convenient manner. For example, the chains 28 may be wrapped around a cylindrical bar to which the bucket F is pivotally attached, or eyelets 34 may be welded to the bucket F, as shown in FIG. 4, in order to receive a hook 31, closable link, or other attachment means at the end of the chain 28. The apparatus 10 is attached to the excavator A by maneuvering the bucket F over the top surface of the body 12 from rear to front in order to slide the leading edge of the bucket F into the slots 27 with the hooks 22 lodged between adjacent teeth H and the leading edge abutting the vertical legs 24. The chains 28 are then wrapped around the rear of the bucket F and attached, directly or indirectly, to a top portion of the rear of the bucket F, and the load binders 30 are used to tighten the chains 28 and draw the top surface 14 of the body snugly against the bucket F.

The apparatus 10 has a support arm 36 extending from the front surface 16 of the body 12. The support arm 36 has a spherical ball 38 at its free end. The ball 38 is insertable in a socket 42 mounted on the blade 40, compactor, or other accessory. A particularly useful form of socket 42 is a split collar type, in which the ball 38 is inserted into the collar which is subsequently tightened around the ball 38 with clamps. This form of socket 42 has been used for mounting blades on bulldozers and the like. The ball 38 and socket 42 joint permits angle adjustment of the blade 40 horizontally in the direction of the arrows 44 shown in FIG. 3 (rotation in the horizontal plane of the support arm 36), or tilt adjustment of the blade 40 vertically in the direction of the arrows 46 shown in FIG. 4 (rotation in a vertical plane normal to the support arm 36).

The apparatus 10 may include hydraulic means for adjusting the angle or tilt of a blade 40 or other accessory attached to the excavator A. In the embodiment shown in FIGS. 1–4, the apparatus includes a pair of double action hydraulic cylinders 48 for adjustment of the angle of the blade 40, and at least one hydraulic cylinder 52 for adjustment of the tilt of the blade 40. The angle adjustment cylinders 48 are mounted to devises 56 on opposites sides 20 of the body 12 by bolts, pins or the like. The pistons 50 are connected to devises 58 attached to the rear surface of the blade 40 laterally on opposite sides of the socket 42. The devises 56 and 58 are mounted with their ears disposed in horizontal planes so that the pistons 50 extend in a substantially horizontal plane to adjust the angle of the blade 40. The cylinders 48 are connected by hydraulic hoses 60 to quick connect fittings 62 mounted on the opposite sides 20 of the apparatus body 12. The body 12 is connected to the hydraulic system of the excavator by hydraulic hoses 64, which may be mounted on the rear surface 18 or other convenient location on the body 12, so that adjustment of the angle and tilt of the blade 40 may be made by operation of hydraulic controls from the cab B. Hydraulic passages and/or a pressure accumulator may be mounted either internally or externally on the body 12.

FIGS. 2 and 3 show an embodiment in which tilt adjustment is accomplished with one hydraulic cylinder 52 mounted to the upper portion of the front face 16 of the body by a clevis 66 and pin arrangement. The piston 54 is connected to the rear face of the blade 40 by a second clevis 68 and pin mounted towards the bottom portion of the blade 40. The clevises 66 and 68 are mounted with their ears oriented in a vertical plane, so that the piston 54 extends and retracts in a substantially vertical plane to accomplish tilt adjustment. The cylinder 52 includes hydraulic hoses 70 which connect to quick connect hydraulic fittings on the front face 16 of the body 12, and are in fluid communication with the excavator's A hydraulic system by hoses 64.

FIG. 4 shows an embodiment of the apparatus 10 in which two hydraulic cylinders 52 are provided for tilt adjustment. In this embodiment the apparatus includes a plate 72 welded to the top surface 14 of the body 12 so that the plate 72 overhangs the body 12 on opposite sides 20. The cylinders 52 may then be mounted on clevises 74 depending from the plate 72. In this embodiment, the clevises 68 may be mounted on the upper portion of the rear face of blade 40. The cylinders 52 may be in fluid communication so that when the piston 54 of one cylinder 52 is extended, the piston 54 of the other cylinder 52 is retracted, thereby coacting to cause tilting of the blade 40.

Figure 5:
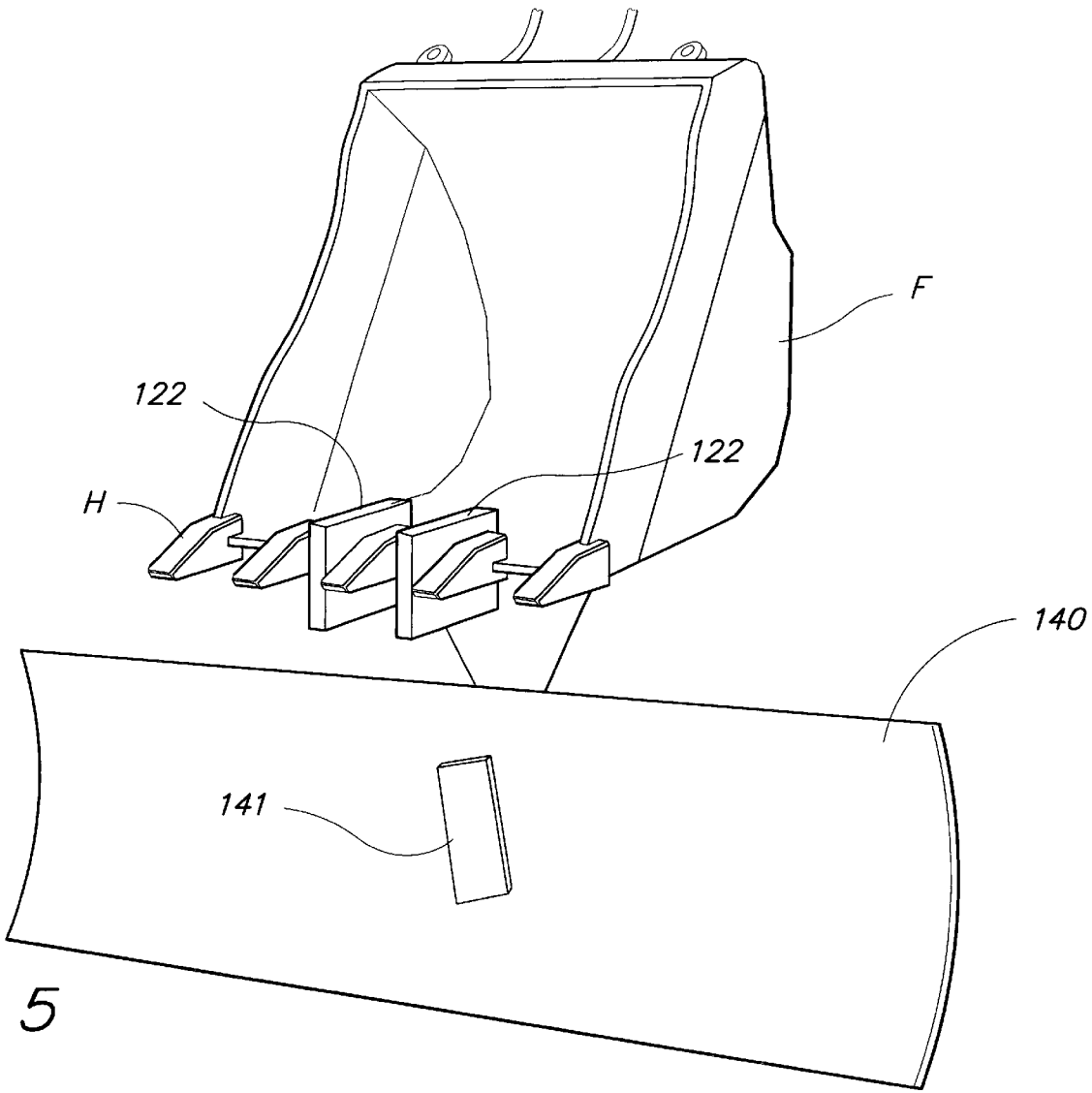
FIG. 5 is an environmental perspective view of an alternative embodiment of an apparatus for attaching an accessory to an excavator according to the present invention.
Figure 6:
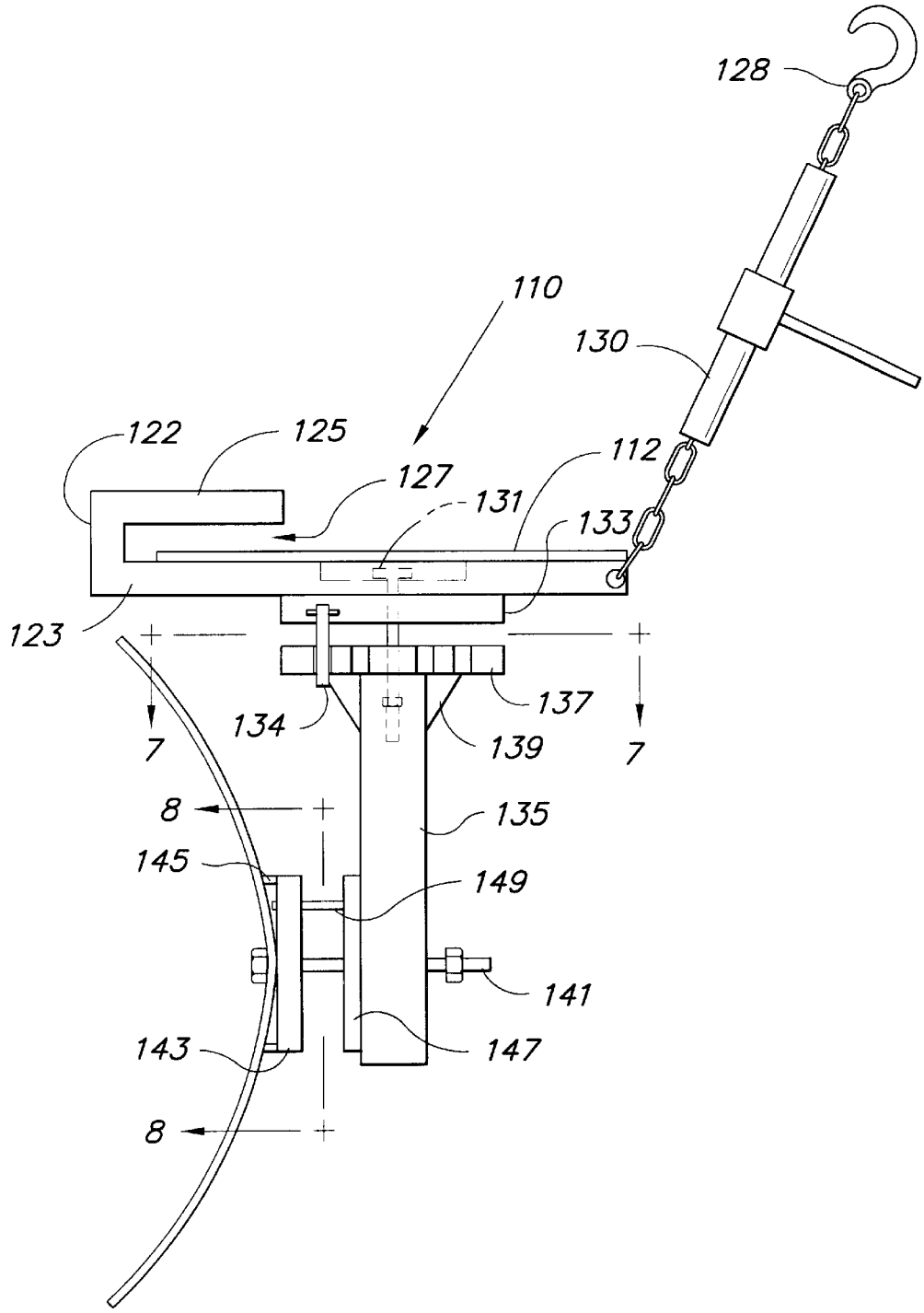
FIG. 6 is a side view of the embodiment of the apparatus for attaching an accessory to an excavator of FIG. 5.

A second embodiment of the apparatus 110 which provides for manual adjustment of the angle and tilt of the blade 140 is shown in FIGS. 5–8. In this embodiment the body 112 of the apparatus 110 is a substantially flat plate. The hooks 122 are formed by 1½" thick plates joined to form a horizontal J-shape, the longer leg 123 of the J-shaped hooks 122 being welded or otherwise joined to the bottom face of the plate 112, and the shorter leg 125 of the J-shaped hooks 122 extending parallel to the body 112 to define slots 127 for receiving the leading edge of the bucket F. As shown in FIG. 5, the apparatus 110 is attached to the bucket F by inserting the leading edge of the shovel bucket F into the slot 127, the hooks 122 being inserted between adjacent pairs of teeth H, the chains 128 being wrapped over the rear of the bucket F and attached to the upper portion of the rear of the bucket F as described above, and ratcheting the load binders 130 to tighten the chains 128.

Figure 7:
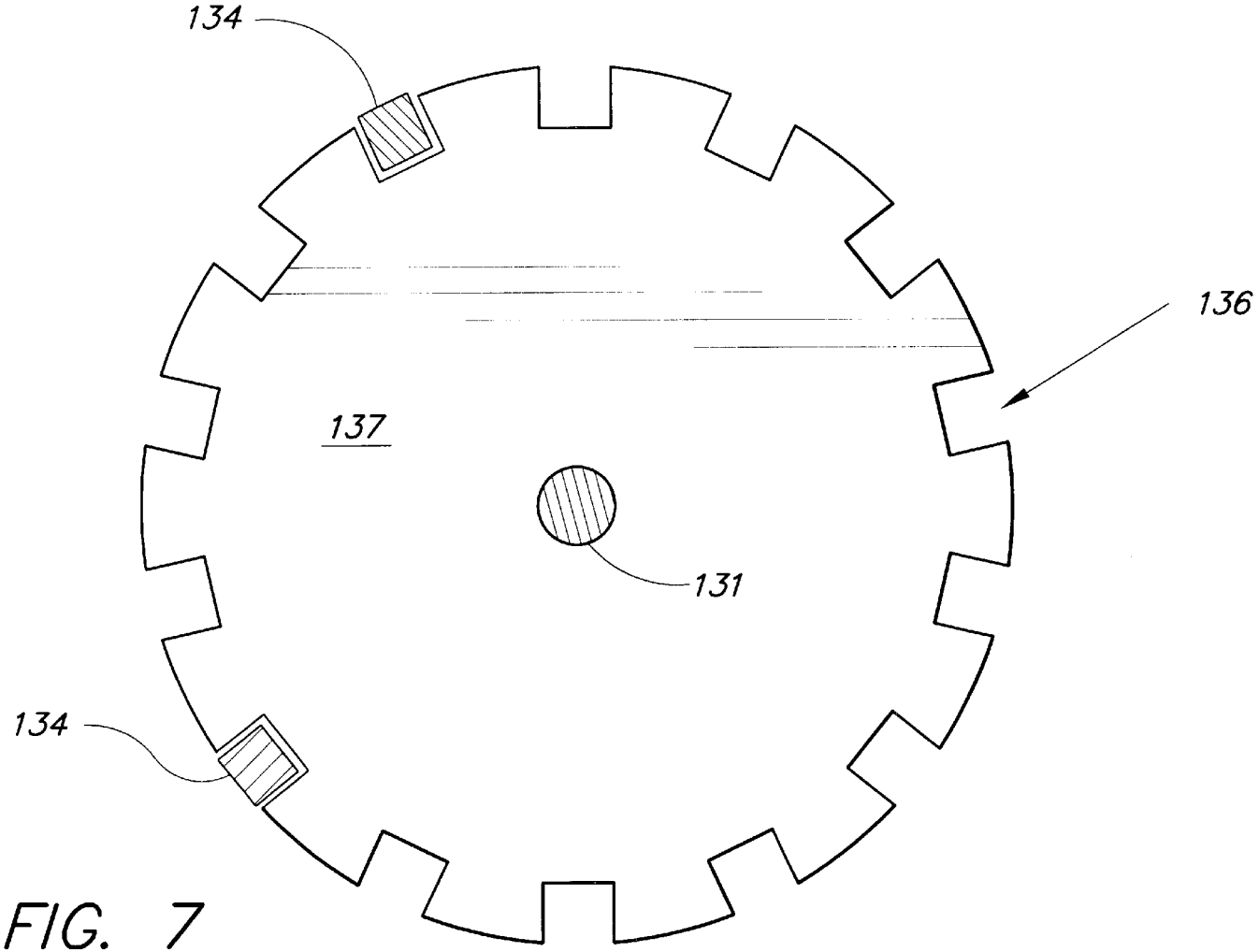
FIG. 7 is a section view along the line 7—7 of FIG. 6.
Figure 8:
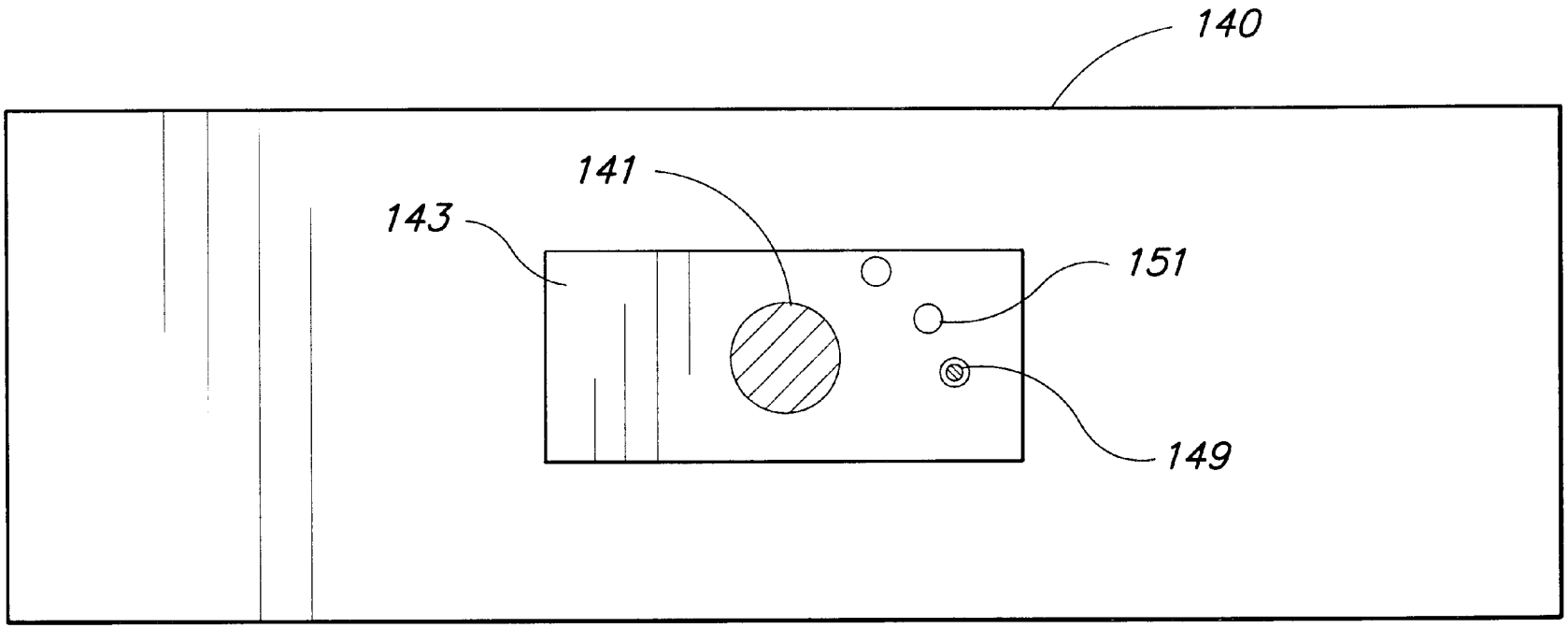
FIG. 8 is a section view along the line 8—8 of FIG. 6.

In this embodiment, a first pivot pin 131 is attached to and depends from the bottom face of the body 112, extending through a first circular plate 133 which is fixedly attached to the hooks 122. The opposite end of the pivot pin 131 is fixedly attached to a square, tubular post 135, which is connected axially to the pivot pin 131. A second circular plate 137 is fixedly attached to the top of the post 137, the plate being supported by gussets 139. Thus, the post 135 and second circular plate 137 are free to rotate with respect to the body 112 and first circular plate 133. The first circular plate 133 has a pair of cogs 134 hingedly attached to its circumference on opposite sides of the post 135. As shown in FIG. 7, the second circular plate 137 has a plurality of notches 136 defined about its circumference, the notches being sized and dimensioned for receiving the cogs 134 in order to lock the first circular plate 133 to the second circular plate 137 and thereby prevent further rotation of the post 135.

The blade 140 is attached to the apparatus 110 by a second pivot pin 141 which extends through the blade 140 and the post 135. A first tilt adjustment plate 143 is fixedly attached to the rear face of the blade 140 and supported by braces 145, while a second tilt adjustment plate 147 is fixedly attached to the post 135 in parallel relation to the first adjustment plate 143. Thus, the first tilt adjustment plate 143 is free to rotate with respect to the second tilt adjustment plate 147. The apparatus includes a lock pin 149 which may be inserted through a hole in the second tilt adjustment plate 147 and one of a plurality of holes 151, shown in FIG. 8, defined radially in the first tilt adjustment plate 143 in order to prevent further rotation of the first tilt adjustment plate 143 with respect to the second tilt adjustment plate 147, thus preventing further rotation of the blade 140 with respect to the post 135 about second pivot pin 141.

In operation, the apparatus 110 is mounted to the excavator A as described above. The angle of the blade 140 is adjusted manually by unlatching the cogs 134, rotating the blade 140 about first pivot pin 131, and securing the angle by aligning the cogs 134 with the nearest notches 136 and latching the cogs 134 in the notches 136. The tilt of the blade 140 is adjusted manually by removing lock pin 149, rotating the blade 140 about the second pivot pin 141, and reinserting lock pin 149 through second tilt adjustment plate 147 and the nearest hole 151 in first adjustment plate 143.

Figure 9:
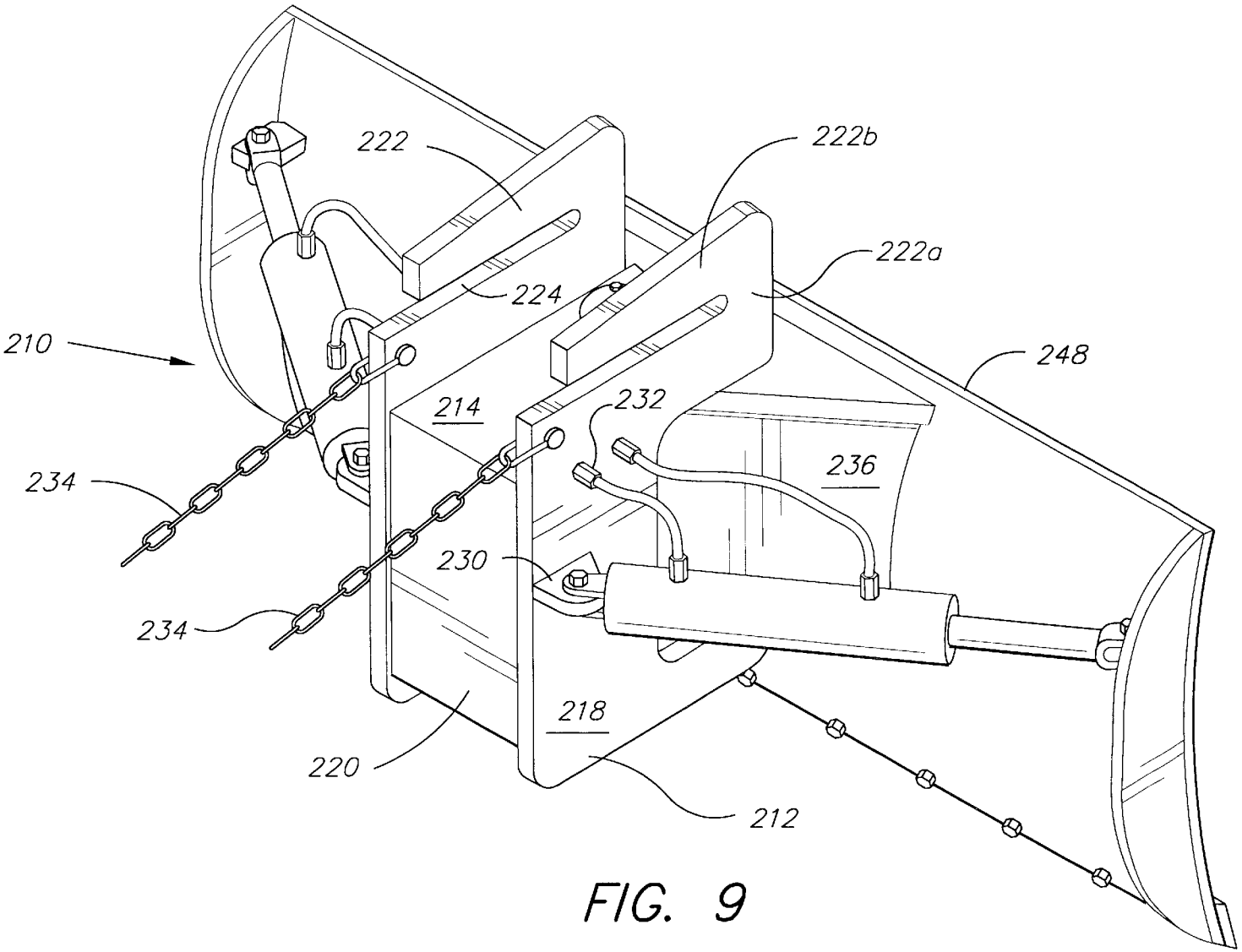
FIG. 9 is a rear perspective view of a third embodiment of an apparatus for attaching an accessory to an excavator according to the present invention.
Figure 10:
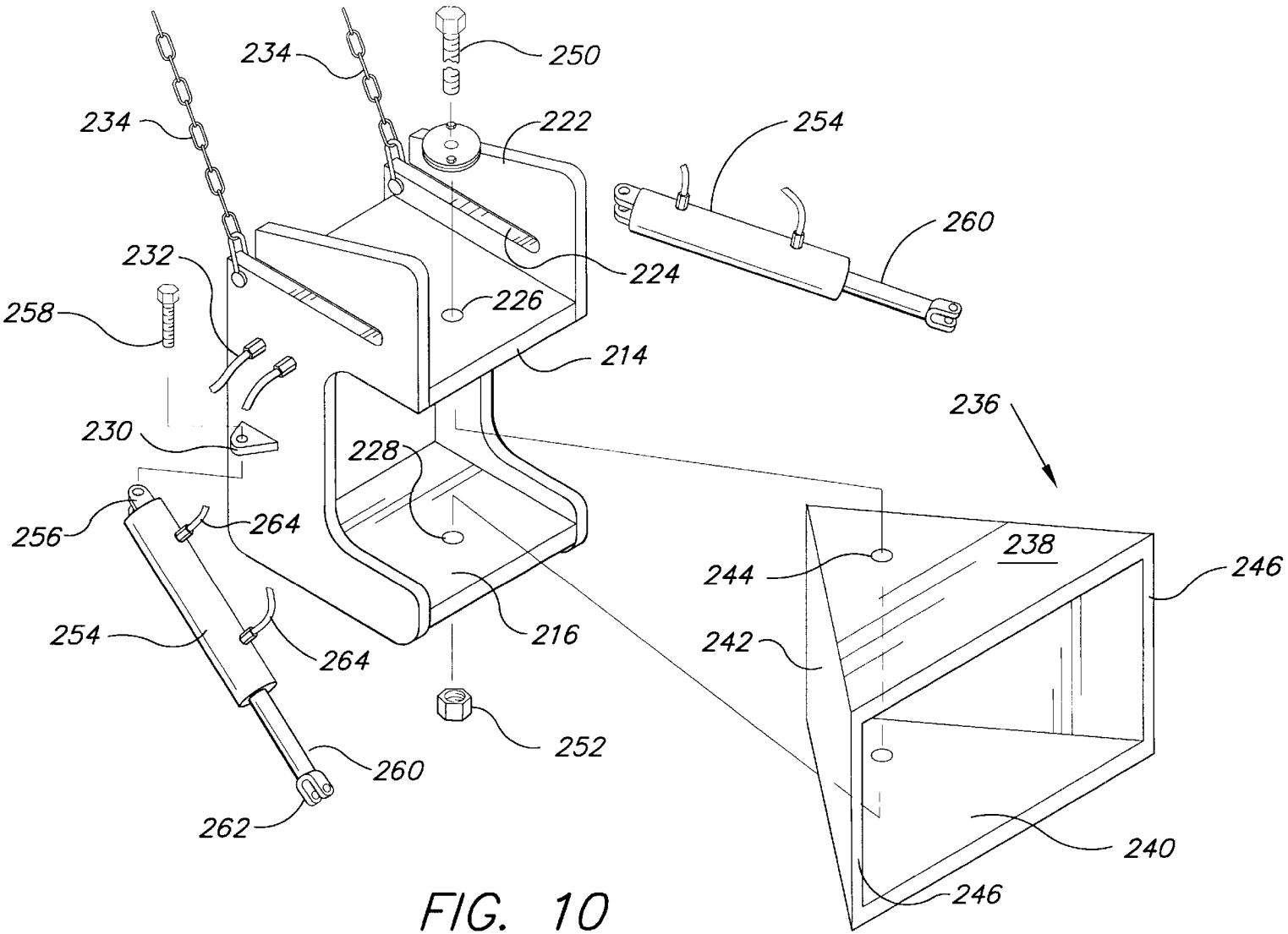
FIG. 10 is an exploded view of the apparatus of FIG. 9.

FIGS. 9 and 10 show a third, and preferred, embodiment of the apparatus, designated generally as 210. In this embodiment, the apparatus 210 has a hollow, C-shaped body 212 having a top plate 214, a bottom plate 216, two opposing side plates 218, a rear face 220, and an open front end. The side plates 218 are scalloped to define the C-shape, and extend above the top plate 214 to define a pair of hooks 222 having a vertical leg 222*a* and a horizontal leg 222*b* extending rearward above and parallel to the top plate 214, each hook 222 defining an elongated slot 224. The top plate 214 has a first hole defined 226 therein, and the bottom plate 216 has a second hole 228 defined therein in registry with the first hole 226. The side plates 218 each have an ear 230 extending therefrom, and a pair of quick connect hydraulic fittings 232 disposed thereon. A pair of chains 234 of the same type as chains 28, described above, are attached to the side plates 218.

The apparatus 210 also includes a hollow, pie shaped wedge 236 having a top plate 238, a bottom plate 240, two side plates 242 and an open front end. The top plate 238 has a hole 244 defined therein at the vertex opposite the open front end, and the bottom plate 240 has a similar hole symmetrically disposed opposite the hole 244 in the top plate 238. The front edges 246 of the side plates 242 are slightly arcuate to match the contour of the rear face of the blade 248, or other accessory, to which the pie shaped wedge 236 is welded. A pivot pin 250, such as an elongated bolt or rod, extends through the hole 226 in the top plate 214 of the C-shaped body 212, the holes 244 in the top plate 238 and bottom plate 240 of the wedge 236 and the bottom plate 216 of the C-shaped body 212, where it is secured by a nut 252 or other means. The height of the pie shaped wedge is slightly smaller than the scalloped openings in the side plates 218 of the C-shaped body 212 so that the pie shaped wedge is free to rotate through the C-shaped opening.

The apparatus 210 further includes a pair of hydraulic cylinders 254 which are attached between the side plates 218 of the C-shaped body 212 and the lateral edges of the blade 248 or other accessory. The base of the cylinder has a clevis 256 which is attached to the ear 230 by a bolt 258 or other pivot pin, and the piston 260 has a clevis 262 which may be pivotally attached to an ear welded to the rear face of the blade 248. Hydraulic hoses 264 extend between the cylinders 254 and the quick connect fittings 232 on the side plates 218 of the C-shaped body 212. Other hydraulic lines (not shown) connect the quick connect fittings 232 to the hydraulic system of the excavator A and are not shown for clarity.

In use, the apparatus 210 is attached to the bucket of the excavator A by sliding the edge of the bucket F into the slots 224, the hooks 222 lodging between two pairs of teeth H on the bucket F, and the chains 234 are wrapped around the rear of the bucket F and tightened by ratcheting the load binders, as described with the embodiments described above. The angle of the blade 248 or other accessory may be adjusted laterally by actuating the hydraulic cylinders 254. Adjustment of the tilt of the blade is accomplished through manipulation of the boom D and shovel arm E.

It is to be understood that the present invention is not limited to the sole embodiments described above, but encompasses any and all embodiments within the scope of the following claims.

We claim:

1. An apparatus for attaching an accessory to a bucket of an excavator, the apparatus comprising:

(a) a hollow C-shaped body having a top plate, a bottom plate, a pair of opposing side plates connecting the top plate and the bottom plate, a rear plate attached to said top plate and said bottom plate, and an open front end, the top plate and the bottom plate each having a hole defined therein, the holes being in registry, the side plates being scalloped to define a C-shape, the side plates having a portion extending above the top plate;

(b) a pair of hooks defined by the portion of the side plates extending above the top plate of said C-shaped body, the hooks being spaced apart a predetermined distance, each of said hooks having a leg extending towards the rear of said C-shaped body parallel to and above the top plate of said C-shaped body in order to define a slot;

(c) a hollow, pie-shaped wedge having a substantially triangular top plate, a substantially triangular bottom plate, and a pair of side plates connecting the top plate and the bottom plate, the pie-shaped wedge having an open front end and having a hole defined through the top plate and the bottom plate adjacent the vertex opposite the front end;

(d) a pivot pin extending through the holes defined in the top and bottom plates of said C-shaped body and said pie-shaped wedge;

(e) a pair of chains, each chain having a first end attached to the rear of said body and a second end attachable to a bucket of an excavator, each chain including a load binder intermediate the first end and the second end for tightening the chain; and (f) a pair of hydraulic cylinders, each cylinder having a first end pivotally attached to one of the side plates of said C-shaped body and having an extensible piston at an opposite second end, the pistons being adapted for attachment to opposite ends of an accessory in order to pivot the accessory laterally;

(g) wherein a leading edge of an excavator bucket is slidable into the slots defined by said hooks with each hook being slidably disposable between an adjacent pair of bucket teeth, said chains being wrapped about the bucket and attachable to a trailing edge of the bucket and tightenable to snugly secure said body to the bucket.

2. The apparatus for attaching an accessory to a bucket of an excavator according to claim 1, further comprising an accessory attached to the front end of said pie-shaped wedge.

3. The apparatus for attaching an accessory to a bucket of an excavator according to claim 1, further comprising a grader blade attached to the front end of said pie-shaped wedge, said pistons being pivotally attached to opposite ends of said grader blade.

* * * * *